US005155534A

United States Patent [19]

Kurotori et al.

[11] Patent Number: 5,155,534

[45] Date of Patent: Oct. 13, 1992

[54] APPARATUS FOR FORMING AND DEVELOPING LATENT ELECTROSTATIC IMAGES WITH LIQUID DEVELOPER AND RELEASE AGENT

[75] Inventors: Tsuneo Kurotori, Tokyo; Manabu Mochizuki, Yokohama; Ichiro Tsuruoka, Tokyo; Katsuhiro Echigo, Yokohama; Itsuo Ikeda, Sagamihara, all of Japan

[73] Assignee: Ricoh Company, Ltd., Tokyo, Japan

[21] Appl. No.: 583,794

[22] Filed: Sep. 17, 1990

[30] Foreign Application Priority Data

Sep. 29, 1989 [JP] Japan ..... 1-254838
Sep. 29, 1989 [JP] Japan ..... 1-254839

[51] Int. Cl.[5] ..... G03G 15/10

[52] U.S. Cl. ..... 355/256; 355/284; 355/293; 430/117

[58] Field of Search ..... 355/245, 256, 282, 289, 355/290, 284, 293; 118/661, 651, 659; 219/216; 430/100, 117, 118, 99, 104, 105, 106, 119, 98, 116, 113, 112

[56] References Cited

U.S. PATENT DOCUMENTS 3,779,639 12/1973 Tamai ..... 355/256 X
3,806,240 4/1974 Tamai et al. ..... 355/256 X
4,059,444 11/1977 Lu et al. ..... 430/112 X
4,065,586 12/1977 Eddy et al. ..... 430/99
4,075,362 2/1978 Concannon ..... 430/99
4,096,314 11/1978 Silverberg ..... 355/256 X
4,214,549 7/1980 Moser ..... 430/99 X
4,515,466 5/1985 Heisler ..... 355/282
4,567,349 1/1986 Henry et al. ..... 219/216
4,842,972 6/1989 Tavernier et al. ..... 430/117
4,876,169 10/1989 Gruber et al. ..... 430/110
5,004,643 4/1991 Caldwell ..... 428/246

*Primary Examiner*—A. T. Grimley
*Assistant Examiner*—T. A. Dang
*Attorney, Agent, or Firm*—Cooper & Dunham

[57] ABSTRACT

In a wet-type image formation apparatus, a latent electrostatic image formation unit; a wet-type development unit for developing a latent electrostatic image into a visible toner image with a liquid developer constituted of (a) a carrier liquid constituted of or including a silicone oil with a siloxane structure and (b) toner particles constituted of or including a coloring agent and a binder resin, which are dispersed in the carrier liquid; an image-transfer unit; and an image-fixing unit including a heat-application roller, the surface of which is coated with a release agent constituted of or including silicone oil with a siloxane structure.

4 Claims, 1 Drawing Sheet

APPARATUS FOR FORMING AND DEVELOPING LATENT ELECTROSTATIC IMAGES WITH LIQUID DEVELOPER AND RELEASE AGENT

BACKGROUND OF THE INVENTION

1. Field of the Invention

The present invention relates to a wet-type image formation apparatus, such as a wet-type electrophotographic copying apparatus, and in particular to a wet-type image formation apparatus in which a latent electrostatic image formed on an electrophotographic photoconductive member or electrostatic recording member is developed with a liquid developer.

2. Discussion of Background

In the conventional wet-type image formation apparatus such as a wet-type electrophotographic copying apparatus, visible toner images are formed on a transfer sheet in such a manner that an electrophotographic photoconductor, usually drum-shaped, is uniformly charged to a predetermined polarity by a main charger and exposed to light images which are converted from original images by an optical scanning system. Thus, latent electrostatic images are formed on the surface of the photoconductor. The thus formed latent electrostatic images are developed to visible toner images with a liquid developer. The visible toner images formed on the photoconductor are transferred to a transfer sheet and fixed thereto using a heat-application roller.

The liquid developer used in the above-mentioned wet-type development process is prepared by dispersing toner particles in a carrier liquid. For the carrier liquid, petroleum aliphatic hydrocarbons such as nonane, decane, dodecane, isooctane, isododecane and ligroin are usually used in combination.

The surface of the above-mentioned heat-application roller is generally coated with a release agent such as a silicone oil to prevent the transfer sheet from adhering to the heat-application roller in the image-fixing operation.

Recently, many functions are performed by the copying apparatus. For instance, a duplex or double-sided copying operation and a synthetic copying operation can usually be carried out by the copying apparatus. The double-sided copying operation is performed in such a manner that first one side of a transfer sheet then the other is subjected to the copying operation. In the synthetic copying operation, after a copy has been formed on one side of the transfer sheet, the same side thereof is again subjected to the copying operation, so that images are overlaid on the preceding images. These two kinds of copying operations have the characteristics that one transfer sheet is repeatedly subjected to the copying operation in common.

These copying operations have the drawback that a small amount of the release agent which has been applied to the heat-application roller is deposited on the surface of the transfer sheet during the image fixing of the preceding copying operation. When the transfer sheet on which a slight amount of the release agent is deposited is subjected to the succeeding copying operation, the release agent inevitably comes in contact with the surface of the photoconductor and adheres thereto. The release agent which has adhered to the surface of the photoconductor is removed therefrom when the residual liquid developer deposited on the photoconductor is cleared therefrom in a cleaning unit after development. Thus, the release agent is collected and returned to a liquid developer reservoir together with the residual liquid developer. As the double-sided copying operation or synthetic copying operation proceeds for an extended period of time, the amount of the release agent which is mixed with the liquid developer is gradually increased and a bubbling problem is produced in the liquid developer. This causes the liquid developer to flow to the outside of the development unit and the squeezing properties of a reverse squeezing roller to deteriorate.

SUMMARY OF THE INVENTION

Accordingly, an object of the present invention is to provide a wet-type image formation apparatus capable of constantly yielding high quality images with high reliability, free from the bubbling phenomenon in the liquid developer caused by the release agent being mixed with the liquid developer in the double-sided copying operation or synthetic copying operation.

The above-mentioned object of the present invention can be achieved by a wet-type image formation apparatus comprising: (i) a latent electrostatic image formation means for forming on a latent-electrostatic-image-bearable photoconductive member a latent electrostatic image corresponding to an original image; (ii) a wet-type development means for developing the latent electrostatic image into a visible toner image with a liquid developer which comprises (a) a carrier liquid comprising a silicone oil with a siloxane structure and (b) toner particles comprising a coloring agent and a binder resin, which are dispersed in the above carrier liquid; (iii) an image-transfer means for transferring the visible toner image from the photoconductive member to a transfer sheet; and (iv) an image-fixing means for fixing the visible toner image to the transfer sheet, which image-fixing means comprises a heat-application roller, the surface of which is coated with a release agent comprising a silicone oil with a siloxane structure.

BRIEF DESCRIPTION OF THE DRAWING

A more complete appreciation of the invention and many of the attendant advantages thereof will be readily obtained as the same becomes better understood by reference to the following detailed description when considered in connection with the accompanying drawing, wherein.

DESCRIPTION OF THE PREFERRED EMBODIMENTS

Figure 1:
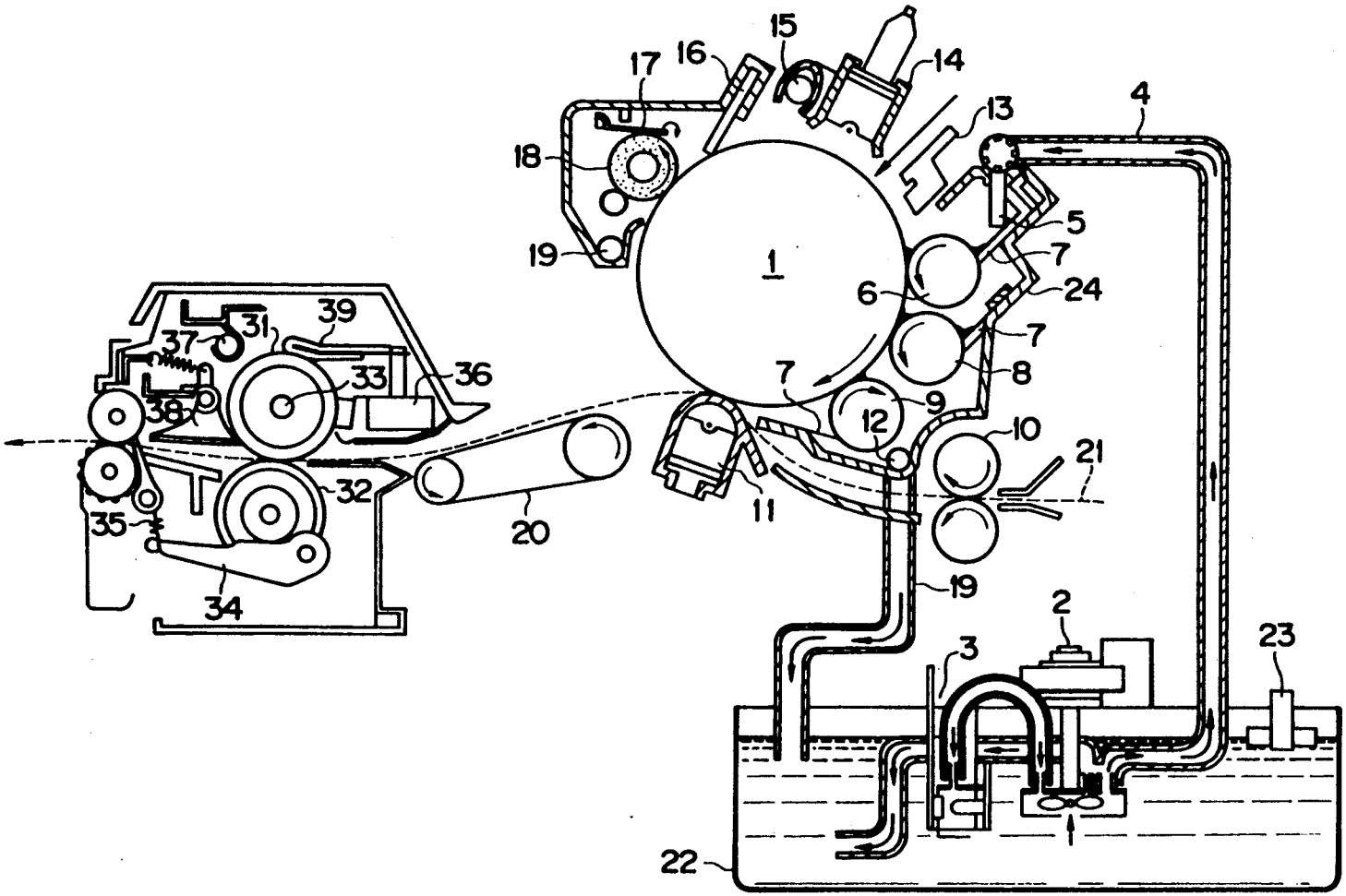
FIG. 1 is a schematic front view of an example of a wet-type image formation apparatus according to the present invention.

FIG. 1 is a schematic view of the mechanism in a wet-type electrophotographic copying apparatus, one example of the wet-type image formation apparatus according to the present invention.

In FIG. 1, a photoconductive drum 1 is rotatably driven in the direction of the arrow at a constant speed by a drive system (not shown) in the course of a copying operation. The outer surface of the photoconductive drum 1 is uniformly charged to a predetermined polarity by a main charger 14, and exposed to a light image which is converted from an original image by an optical system. Thus, a latent electrostatic image is formed on the surface of the photoconductive drum 1. Non-image-formation areas on the photoconductive drum 1 are quenched by an eraser 13.

The latent electrostatic image formed on the photoconductive drum 1 is developed to a visible toner image by a first development roller 6 and a second development roller 8 which together support a liquid developer. The development rollers 6 and 8 are rotatably driven in the direction of the arrow, with a slight gap between the development rollers and the photoconductive drum 1. The residual toner particles are cleared from the development rollers 6 and 8 by scrapers 7 which are positioned with an end portion thereof in contact with the surface of the respective development rollers 6 and 8.

A liquid developer is supplied to a development unit via a developer supply nozzle 5 from a liquid developer reservoir 22 and retained on the development rollers 6 and 8 and the scrapers 7. While the development rollers 6 and 8 are rotating, the liquid developer is uniformly distributed on the surface of the photoconductive drum 1 and toner particles in the liquid developer are electrostatically attracted to the latent electrostatic image formed on the photoconductive drum 1. Thus, the latent electrostatic image is developed to a visible toner image.

In the development unit, a reverse squeeze roller 9 is disposed with a slight gap being provided between the reverse squeeze roller 9 and the photoconductive drum 1 and is rotated in the direction of the arrow. The reverse squeeze roller 9 serves to squeeze the residual liquid developer from the photoconductive drum 1. The residual liquid developer squeezed by the reverse squeeze roller 12 and the unused liquid developer scraped from the development rollers by the respective scrapers flow into a liquid-developer collection hole 12 and return to the liquid developer reservoir 22 through a liquid developer recovery pipe 19. Reference numeral 24 designates an external cover of the development unit, which also serves as a liquid developer retainer.

The toner image thus developed on the photoconductive drum 1 is transferred via a transfer charger 11 to a transfer sheet 21 which is supplied from a paper supply unit (not shown) and carried by a plurality of sheet-transport rollers 10 along a paper path as indicated by the broken-line.

The transfer sheet 21 which bears the toner image is separated from the surface of the photoconductive drum 1 by separation rollers (not shown) and led to an image fixing unit through a transfer-sheet conveyor belt 20.

In the image fixing unit, the transfer sheet 21 which bears a toner image is caused to pass between a heat-application roller 31 having a built-in heater 33 and a pressure-application roller 32. A pressure-application lever 34 is brought into pressure contact with a shaft of the pressure-application roller 32 by the force of a spring 35. Thus, a predetermined pressure is applied to the pressure-application roller 32 to form a nip between the pressure-application roller 32 and the heat-application roller 31.

As previously mentioned, the heat-application roller 31 is provided with the built-in heater 33 which serves as a heat source in the image fixing operation. The temperature of the heater 33 is controlled by a thermistor 36 and a fuse 37 which are provided outside the heat-application roller 31. In addition, a transfer sheet separation pawl 38 and a release agent application felt 39 are disposed in contact with the outer surface of the heat-application roller 31. In the present invention the release agent application felt 39 is impregnated with a silicone oil with a siloxane structure. After the completion of the image fixing performance, the transfer sheet 21 is separated from the heat-application roller 31 by the transfer sheet separation pawl 38 and discharged to the outside.

After separation of the transfer sheet 21 from the photoconductive drum 1, the residual liquid developer on the photoconductive drum 1 is cleared therefrom by a cleaning foam roller 18 and a cleaning blade 16 in a cleaning unit and discharged through a liquid developer discharging hole 19. Reference numeral 17 designates a plate which has the function of uniformly spreading the liquid developer squeezed by the sponge roller 18. The residual electric charge of the photoconductive drum 1 is then quenched by a quenching lamp 15 (or a quenching charger) to be ready for the subsequent copying operation.

A set of squeeze rollers consisting of a blotter roller and a sponge roller (not shown) may be provided along the paper path to the image fixing unit in order to squeeze out the carrier liquid impregnated in the transfer sheet 21 before the image fixing performance.

Reference numeral 2 designates a pump capable of pumping the liquid developer to the development unit. Reference numeral 3 designates a toner concentration sensor; and reference numeral 23, a developer level detection float sensor.

As mentioned previously, FIG. 1 is a schematic view of the wet-type electrophotographic copying apparatus employing the electrophotographic photoconductor. In the case of a wet-type image formation apparatus employing an electrostatic recording member instead of the electrophotographic photoconductor, there may be a slight difference in the latent electrostatic image formation means. For instance, latent electrostatic images are formed directly on the surface of the electrostatic recording member using a recording head, without the main charger or exposure lamp. The other image forming processes, such as the development process and image fixing process are the same as in FIG. 1.

The process of one-side copying operation has been explained by referring to FIG. 1. The double-sided copying operation or synthetic copying operation is similarly performed on the basis of the aforementioned image forming principle. In these copying operations, the transfer sheet which has finished one cycle of the image forming process is subjected to one more image forming process, so that the small amount of release agent which has been deposited on the surface of the transfer sheet in the first copying operation adheres to the surface of the photoconductor in the second copying operation. The release agent remaining on the surface of the photoconductor is cleared therefrom by the cleaning unit and returned to the liquid developer reservoir. Accordingly, the release agent is gradually mixed with the liquid developer.

In the present invention, both the carrier liquid for the liquid developer and the release agent coated on the heat-application roller comprise a liquid-type silicone oil with a siloxane structure, so that the bubbling problem caused by the release agent being mixed with the liquid developer is avoided.

Examples of the silicone oil with a siloxane structure for use in the present invention are a dimethyl silicone (dimethyl polysiloxane), a methylphenyl silicone (methylphenyl polysiloxane) and a cyclic silicone (cyclic polysiloxane). These silicone oils can be used alone or in combination as both the carrier liquid and the release agent. In other words, the silicone oils with a siloxane structure for the carrier liquid for the liquid developer may be the same as or different from the silicone oils for the release agent.

It is preferable that the viscosity of the silicone oil for the carrier liquid be lower than that of the silicone oil for the release agent. Furthermore, it is preferable that the silicone oil for the carrier liquid have a viscosity of less than 5 cs at 20° C., and the silicone oil for the release agent have a viscosity in the range of 5 to 300 cs at 20° C.

As the silicone oil for the carrier liquid with a viscosity of less than 5 cs, the following straight-chain or cyclic polysiloxane compounds having the formulas (I) to (III) can be employed.

[Dimethyl polysiloxane] (I)

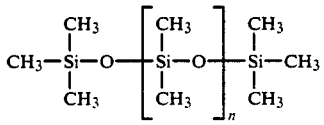

[Methylphenyl polysiloxane] (II)

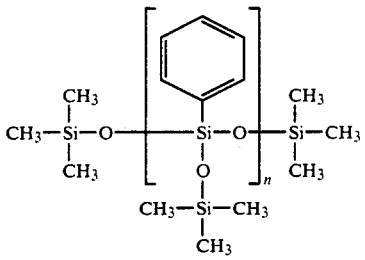

[Cyclic polysiloxane] (III)

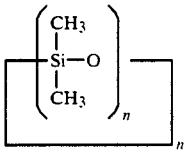

wherein n is an integer of 1 to 4.

Other features of this invention will become apparent in the course of the following description of exemplary embodiments, which are given for illustration of the invention and are not intended to be limiting thereof.

Example 1

The following components were mixed and dispersed to prepare toner particles:

| | Parts by Weight |
|---|---|
| Styrene | 50 |
| Methyl methacrylate | 40 |
| Divinylbenzene | 10 |
| Carbon black "Mitsubishi #44" | 40 |

The thus prepared toner particles were dispersed in a commercially available dimethyl silicone, "KF-96L-0.65" (Trademark) with a viscosity or 0.65 cs, made by Shin-Etsu Polymer Co., Ltd., to prepare a liquid developer. The above-prepared liquid developer was poured into a liquid developer reservoir 22 of a wet-type electrophotographic copying apparatus as shown in FIG. 1.

A release agent application felt 39 of the copying apparatus was impregnated with a commercially available dimethyl silicone, "KF-96" (Trademark) with a viscosity of 300 cs, made by Shin-Etsu Polymer Co., Ltd.

Using the above-mentioned wet-type electrophotographic copying apparatus, 2000 double-sided copies and 2000 synthetic copies were made in succession by passing commercially available plain transfer sheets, "Type 6200" (A-4 size), made by Ricoh Company, Ltd., through the apparatus at a linear speed of 266 mm/sec at 23±2° C. and 55±5% RH. In this copying test, an original chart having an image area of 7% was used. The results are shown in Table 1.

Examples 2 to 8 and Comparative Example 1

The same toner particles as those employed in Example 1 were dispersed in the respective carrier liquids as shown in Table 1, so that liquid developers were separately prepared. Each of the above-prepared liquid developers was used in turn in the same wet-type electrophotographic copying apparatus as employed in Example 1.

The same release agent application felt 39 as used in Example 1 was impregnated with the respective silicone oils as shown in Table 1 in turn.

Using the above-mentioned wet-type electrophotographic copying apparatus, copying tests were carried out in the same manner as employed in Example 1. The results are shown in Table 1.

TABLE 1

| | Carrier Liquid | Release Agent for Image-fixing Roller | Bubbling Problem |
|---|---|---|---|
| Exa. 1 | Dimethyl silicone "KF-96L-0.65" (*0.65) made by Shin-Etsu Polymer Co., Ltd. | Dimethyl silicone "KF-96" (300) made by Shin-Etsu Polymer Co., Ltd. | Nil |
| Exa. 2 | Dimethyl silicone "KF-96L-1" (1) made by Shin-Etsu Polymer Co., Ltd. | Dimethyl silicone "KF-96" (300) made by Shin-Etsu Polymer Co., Ltd. | Nil |
| Exa. 3 | Dimethyl silicone "KF-96L-1.5 (1.5) made by Shin-Etsu Polymer Co., Ltd. | Dimethyl silicone "KF-96" (300) made by Shin-Etsu Polymer Co., Ltd. | Nil |
| Exa. 4 | Dimethyl silicone "KF-96L-2" (2) made by Shin-Etsu Polymer Co., Ltd. | Dimethyl silicone "KF-96" (300) made by Shin-Etsu Polymer Co., Ltd. | Nil |
| Exa. 5 | Methylphenyl silicone "KF-58" (4) made by Shin-Etsu Polymer Co., Ltd. | Dimethyl silicone "KF-96" (300) made by Shin-Etsu Polymer Co., Ltd. | Nil |
| Exa. 6 | Methylphenyl silicone "KF-58" (4) made by Shin-Etsu Polymer Co., Ltd. | Methylphenyl silicone "KF-56" (14) made by Shin-Etsu Polymer Co., Ltd. | Nil |
| Exa. 7 | Cyclic polysiloxane "KF-994" (2.3) made by Shin-Etsu Polymer Co., Ltd. | Dimethyl silicone "KF-96" (300) made by Shin-Etsu Polymer Co., Ltd. | Nil |
| Exa. 8 | Dimethyl silicone "KF-96L-1 (1) made by Shin-Etsu Polymer Co., Ltd. | Cyclic polysiloxane "KF-994" (2.3) made by Shin-Etsu Polymer Co., Ltd. | Nil |
| Comp. Exa. 1 | Isoparaffin aliphatic hydrocarbon "Isopar H" made by Exxon Chemical Japan Ltd. | Dimethyl silicone "KF-96" (300) made by Shin-Etsu Polymer Co., Ltd. | Observed (**) |

(*)The figures in parentheses indicate the viscosity of the silicone oil in centistoke.
(**)The liquid developer bubbled in the cleaning unit and flowed therefrom.

As can be seen from the results in Table 1, when 2000 copies in succession were made by the double-sided copying operation and by the synthetic copying operation, the bubbling problem did not occur in the case of Examples 1 to 8 in which the wet-type image formation apparatus according to the present invention was employed.

To the contrary, in Comparative Example 1, the liquid developer bubbled in the cleaning unit and flowed therefrom. As a result, the inside of the copying apparatus was stained with the liquid developer. In addition to the above, the reverse squeeze roller did not operate normally, so that abnormal images were obtained because of the uneven squeezing properties of the reverse squeeze roller.

According to the present invention, since a silicone oil with a siloxane structure is used as both the carrier liquid for the liquid developer and the release agent for the heat-application roller in the image-fixing unit, the bubbling problem does not occur in the liquid developer when the aforementioned release agent mingles with the liquid developer in the repeated double-sided and synthetic copying operations. Therefore, high quality images can constantly be obtained with high reliability.

What is claimed is:

1. A wet-type image formation apparatus comprising:

a latent electrostatic image formation means for forming, on a latent-electrostatic-image-bearable photoconductive member, a latent electrostatic image corresponding to an original image;

a wet-type development means for developing said latent electrostatic image into a visible toner image with a liquid developer which comprises (a) a carrier liquid comprising a first silicone oil with a siloxane structure and (b) toner particles comprising a coloring agent and a binder resin, which are dispersed in said carrier liquid;

an image-transfer means for transferring said visible toner image from said photoconductive member to a transfer sheet; and an image-fixing means for fixing said visible toner image to said transfer sheet, which comprises a heat-application roller, the surface of which is coated with a release agent comprising a second silicone oil with a siloxane structure, wherein the viscosity of said first silicone oil used as said carrier liquid for said liquid developer is lower than that of said second silicone oil used as said release agent for said heat-application roller.

2. The wet-type image formation apparatus as claimed in claim 1, wherein said first silicone oil used as said carrier liquid for said liquid developer has a viscosity of less than 5 cs at 20° C. and said second silicone oil used as said release agent for said heat-application roller has a viscosity of 5 to 300 cs at 20° C.

3. The wet-type image formation apparatus as claimed in claim 2, wherein said first silicone oil used as said carrier liquid for said liquid developer is selected from the group consisting of a dimethyl polysiloxane of formula (I), a methylphenyl polysiloxane of formula (II) and a cyclic polysiloxane of formula (III);

(I)

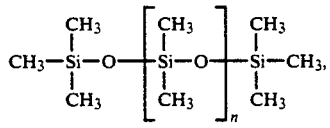

(II)

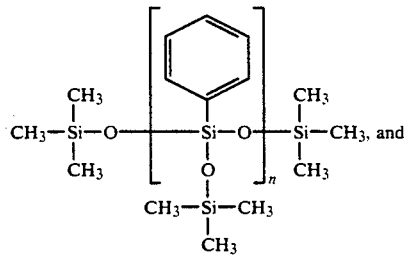

(III)

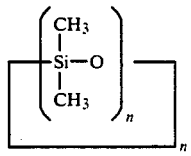

wherein n is an integer of 1 to 4.

4. Apparatus as defined in claim 1, wherein, after a first visible toner image is transferred to and fixed to a transfer sheet, the transfer sheet is returned to the image-transfer means for transfer of a second visible toner image thereto.

* * * * *